US006053152A

United States Patent [19]

Ratner

[11] Patent Number: 6,053,152

[45] Date of Patent: Apr. 25, 2000

[54] FUEL CONDITIONING ASSEMBLY

[76] Inventor: Lee Ratner, 5901 Town Bay Dr., #814, Boca Raton, Fla. 33486

[21] Appl. No.: 09/249,878

[22] Filed: Feb. 16, 1999

Related U.S. Application Data

[63] Continuation-in-part of application No. 08/782,348, Jan. 13, 1997.

[51] Int. Cl.[7] ..... F02M 33/00

[52] U.S. Cl. ..... 123/538

[58] Field of Search ..... 123/536, 537, 123/538, 539

[56] References Cited

U.S. PATENT DOCUMENTS

| | | | |
|---|---|---|---|
| 4,798,191 | 1/1989 | King | 123/538 |
| 4,930,483 | 6/1990 | Jones | 123/538 |
| 5,044,347 | 9/1991 | Ullrich et al. | 123/538 |
| 5,069,191 | 12/1991 | Scouten | 123/538 |
| 5,154,153 | 10/1992 | MacGregor | 123/538 |
| 5,197,446 | 3/1993 | Daywalt et al. | 123/538 |
| 5,305,725 | 4/1994 | Marlow | 123/538 |
| 5,447,625 | 9/1995 | Roe | 123/538 |
| 5,871,000 | 2/1999 | Ratner | 123/538 |
| 5,881,702 | 3/1999 | Arkfeld | 123/538 |

*Primary Examiner*—Marguerite McMahon
*Attorney, Agent, or Firm*—Malloy & Malloy, P.A.

[57] ABSTRACT

A fuel conditioning assembly, structured to be positioned between a fuel supply and a fuel combustion assembly, and including an elongate tubular housing having an inlet end, an outlet end, and a flow through passage extending therebetween. The inlet end is coupled with the fuel supply so as to receive fuel flow therethrough into the flow through passage, wherein a turbulent flow of the fuel is initiated and the fuel is influenced by a combination of metallic elements which chemically condition the fuel flowing through the flow through passage by rearranging the molecular bonds of the fuel with a catalytic effect and separating the fuel particles into a plurality of subatomic particles, thereby reducing a density of the fuel and substantially increasing a fuel burn efficiency. Further, the outlet end of the housing is coupled directly with the fuel combustion assembly so as to provide for the flow of conditioned fuel therebetween without a substantial risk of a diminishing of the effects of the conditioning.

4 Claims, 3 Drawing Sheets

FUEL CONDITIONING ASSEMBLY

The present application is a Continuation-In-Part to co-pending U.S. patent application Ser. No. 08/782,348 filed Jan. 13, 1997 and issuing Feb. 16, 1999, for A FUEL CONDITIONING ASSEMBLY, and which is incorporated herein by reference.

BACKGROUND OF THE INVENTION

1. Field of the Invention

The present invention relates to a fuel conditioning assembly, for use in a combustion engine, which is substantially easy to install and maintenance free, and is structured to provide a more complete combustion of fuel, thereby substantially reducing the emission of pollutants, a cleaner running engine, which requires less maintenance, and significantly increased fuel efficiency for the engine.

2. Description of the Related Art

The natural inefficiency inherent in internal combustion engines is well documented. Specifically, internal combustion engines utilizing fossil fuels typically emit unburned or under-burned fuel from the exhaust as well as the undesirable by-products of combustion. This under-burning of fuel causes severe environmental problems as the resultant pollutants, some of which are thought to be cancer causing, are emitted directly into the atmosphere. In addition to being emitted directly into the atmosphere through the exhaust, many by-products of fuel combustion simply accumulate on internal engine components, with often 30% of the exhaust being directed into the engine. This causes those engine components to wear out sooner and require frequent maintenance and repairs which can lead to shortened total engine life. Furthermore, the incomplete combustion of fuel within an engine substantially under-utilizes the energy capacity of the fuel. Specifically, in addition to the environmental concerns due to pollution attributed to the under-utilization of the energy capacity of fuel, there are also resultant losses in economic efficiency due to higher fuel and maintenance expenses as well as a generally shorter engine life.

Others in the art have developed various fuel conditioning assemblies in an attempt to alleviate some of the above-mentioned problems. For example, in the past various types of heating devices were incorporated into a fuel conditioning assembly so as to raise the temperature of the fuel and thereby improve the combustion properties of the fuel. Specifically, such devices include a heating element which comes into contact with the fuel so as to raise it's temperature and consequently reduce the density of the fuel. Of course, such a procedure can also raise the engine temperature and can prove quite hazardous. Additionally, others in the art have attempted to add various types of additives to the fuel in an attempt to positively effectuate improvement in the fuel's combustion properties. Such additives have included the addition of minute quantities of Cupric salts, for example, to the fuel supply. Unfortunately, however, it can be difficult to obtain and consistently add those additives in an efficient manner, and if the additives are not completely soluble in the fuel, they may be quite harmful to the engine. Accordingly, none of these devices have actually been successfully and practically incorporated with a combustion engine in a simple, economical, and maintenance free manner.

In addition to the above-referenced approaches, others in if the art have sought to introduce various metals, in combination, within a flow of fuel in an attempt to generate a chemical reaction which effects the combustion properties of the fuel. Although some of these devices do improve the combustion properties of the fuel somewhat, those skilled in the art have not been successful in substantially increasing the combustion properties in a practical and effective manner. In particular, such devices have been unable to effectuate a substantial improvement such as would be necessary to offset the price of purchase and installation of the device into existing engines. Indeed, the improved combustion properties provided by existing fuel conditioning assemblies are so slight that a user may find it more economical to increase the combustion properties of the fuel simply by switching to a higher octane rated fuel or by mixing the fuel with an additive.

Accordingly, there is still a need in the art for a practical and cost-effective fuel conditioning assembly which reduces visible smoke as well as other pollutants being discharged through the exhaust, increases fuel efficiency (as quantified in miles per gallon), provides for a cleaner running engine requiring less maintenance, extends the useful life of engine components, is substantially maintenance free, and is substantially easy and safe to implement with existing engine designs.

SUMMARY OF THE INVENTION

The present invention is directed towards a fuel conditioning assembly that is structured to be positioned between a fuel supply and a fuel combustion assembly. In particular, the fuel conditioning assembly includes a preferably rigid housing having an inlet end, an outlet end, and a flow through passage extending from the inlet end to the outlet end.

Moreover, the fuel conditioning assembly is disposed inside the flow through passage and is structured to chemically condition the fuel as it travels through the flow through passage. Specifically, the conditioning assembly is structured to rearrange the molecular bonds of the fuel with a catalytic effect and separate the fuel particles into a plurality of subatomic particles, thereby reducing the density of the fuel and substantially increasing a fuel burn efficiency.

The inlet end of the housing is coupled with the fuel supply so as to receive fuel therethrough into the flow through passage. As such, a generally continuous flow of fuel passes into the housing when the fuel system is operational. Similarly, the outlet end of the housing is coupled with the fuel combustion assembly so as to provide for the flow of conditioned fuel exiting the housing thereto.

It is an object of the present invention to provide a fuel conditioning assembly which rearranges the molecular bonds of a fuel with a catalytic effect and separates fuel particles into a plurality of subatomic particles so as to reduce the density of the fuel and thereby increase the completeness of a burn of the fuel.

A further object of the present invention is to provide a fuel conditioning assembly which provides for more complete combustion of fuel and therefore reduces the emission of fuel from the exhaust as well as the emission of pendant smoke and fumes.

Another object of the present invention is to provide a fuel conditioning assembly which provides for more complete combustion and cleaner burning of fuel so as to provide a cleaner running engine requiring less maintenance.

An additional object of the present invention is to provide a fuel conditioning assembly which increases the fuel efficiency of a vehicle, as measured in miles per gallon, for example.

It is a further object of the present invention to provide a fuel conditioning assembly which is substantially rugged and durable for heavy duty use and does not contain any moving parts or electrical connections which can be damaged or wear out over time.

It is also an object of the present invention to provide a fuel conditioning assembly which is substantially maintenance free.

Yet another object of the present invention is to provide a fuel conditioning system which recognizes and utilizes an ideal combination of elements in order to maximize the effectiveness of the chemical reaction which conditions the fuel.

These and other objects, features, and advantages of the present invention will become more readily apparent from the attached drawings and the detailed description of the preferred embodiments, which follows:

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout the figures, the present invention is directed towards a fuel conditioning assembly, generally indicated as 10. The fuel conditioning assembly 10 is structured to be connected in line with an engine's fuel system in order to effectively treat and condition the fuel prior to its combustion within the engine, thereby ensuring that a more effective, more efficient burn is achieved.

Figure 1:
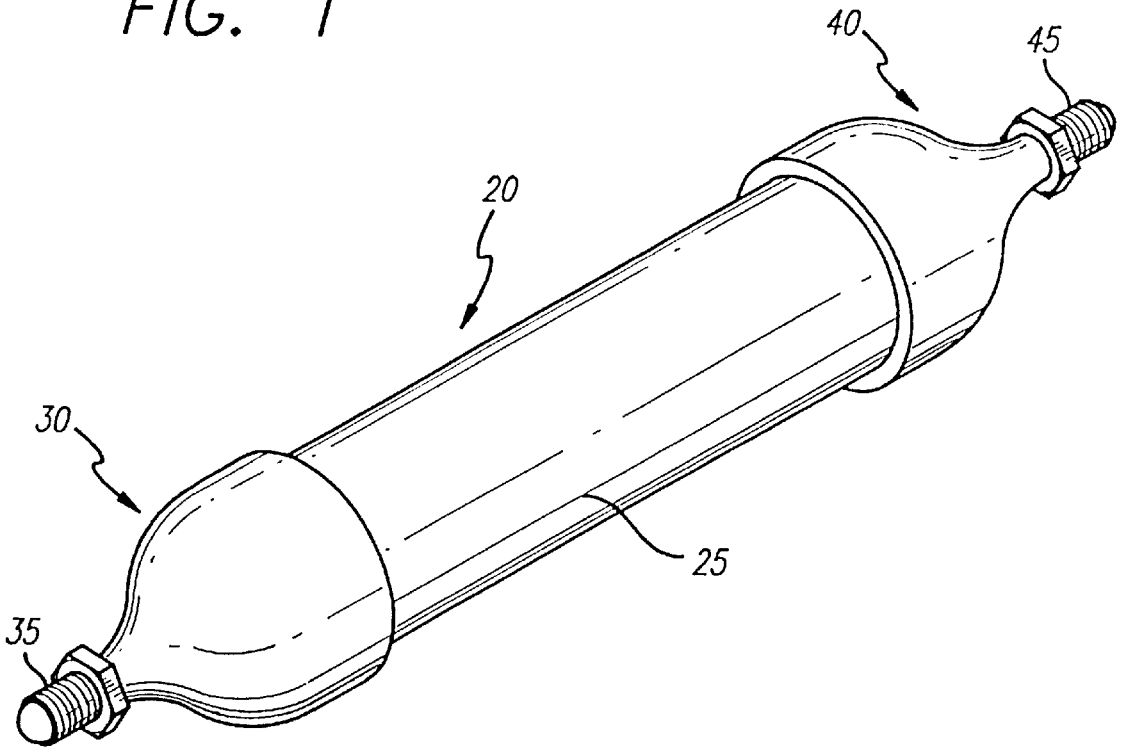
FIG. 1 is a perspective view of the fuel conditioning assembly.
Figure 2:
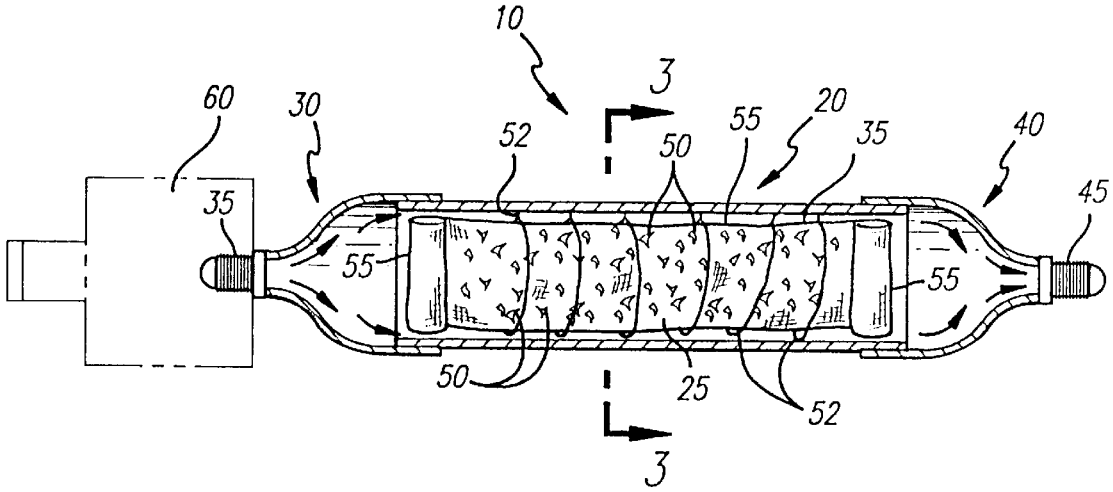
FIG. 2 is a cross-sectional side view of a first embodiment of the fuel conditioning assembly.
Figure 3:
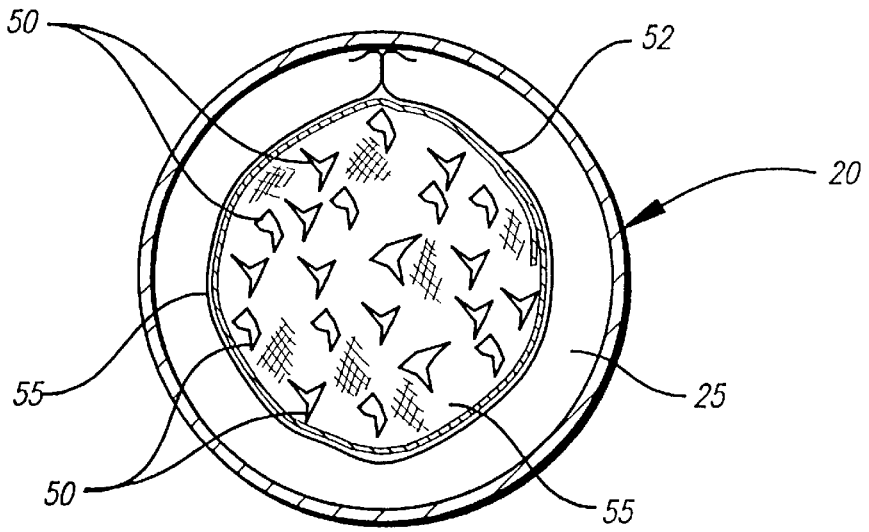
FIG. 3 is a cross-sectional view taken along line A—A of FIG. 2.

In particular, the fuel conditioning assembly 10 includes a housing 20, as shown in the figures. The housing 20, which includes an inlet end 30, an outlet end 40, is preferably rigid in construction, and includes a generally tubular configuration. The inlet and outlet ends 30 and 40 may be defined by separate elements fitted onto a main body, or a single cast element generally defining the entire housing 20 may be utilized. Moreover, extending from the inlet end 30 of the housing to its outlet end 40 is a flow through passage 25, as best shown in FIGS. 2 and 3. As such, fuel is able to pass through the housing 20 where it can be effectively conditioned as a result of the present invention. In the preferred embodiment, the housing 20 is formed of Copper, for reasons to be described subsequently, however, other, preferably rigid, materials including metal and/or plastic materials may also be utilized effectively. Furthermore, the housing 20 preferably includes a generally elongate tubular configuration, as shown in FIGS. 1 and 2, so as to facilitate a desired residence time in which the fuel is within the flow through passage 25 of the housing 20 and is being conditioned. Of course, the length of the housing 20 may be altered to suit particular situations in which more or less conditioning is desired, and also so as to accommodate for the capacity and size requirements of specific engine types. For example, by increasing the length of the housing 20, and therefore the flow through passage 25, the average residence time of a given quantity of fuel is increased and the fuel conditioning reaction which takes place is maximized.

Looking specifically to the inlet end 30 of the housing 20, it is coupled, either directly or indirectly, with a fuel supply of the engine. As such, the inlet end 30 of the housing 20 receives a consistent fuel flow therethrough, and into the flow through passage 25, upon normal operation of the engine's fuel systems. In order to facilitate a substantially tight and leak-proof connection with the fuel supply, the inlet end 30 is preferably outfitted with an inlet nozzle member 35. The inlet nozzle member 35 will preferably be threaded so as to securely, yet removably, engage a fuel line, and may be removably secured to the housing 20 so as to further define the inlet end 30 and define a substantially tight, fluid impervious connection. In the preferred embodiment, the inlet nozzle member 35 is snap-fitted onto the housing 20; However, other means of securing the inlet nozzle member 35 to the housing 20 may be utilized without departing from the present invention. Alternatively, the inlet portion 30 may be integrally formed with the flow through is passage 25 or permanently secured thereon. Furthermore, the inlet end 30 of the housing 20 is preferably structured to permit fuel to flow into and through the flow through passage 25 of the housing 20 at an inlet pressure of between 40 and 60 psi, thereby maintaining a consistent and sufficient flow of fuel therethrough for use in the combustion process. Additionally, in one preferred embodiment, a fuel filter 60 is provided and coupled in fluid flow communication with the inlet end 30 of the housing 20, as shown in FIG. 2. As such, prior to the fuel's entry into the housing 20 where it will be conditioned, the fuel is filtered to remove a variety of particle impurities.

Looking now to the outlet end 40 of the housing 20, it is coupled with the fuel combustion assembly of the engine so as to provide for the flow of conditioned fuel thereto for its subsequent combustion. Like the inlet end 30, the outlet end 40 can be removably secured to the flow through passage 25 of the housing 20. Moreover, an outlet nozzle member 45 may be provided so as to further define the outlet end 40 of the housing 20, and is preferably secured to the housing 20 by a substantially tight and leak-proof connection similar to the snap-fit connection preferably utilized in securing the inlet nozzle member of the 35 inlet end 30 to the housing 20. Alternatively, however, the outlet end 40 may be completely integrally formed with the housing 20 and the flow through passage 25, and/or be permanently secured thereto. In the preferred embodiment, the outlet nozzle member 45 of the outlet end 40 is externally threaded and is structured to be coupled in direct fluid flow communication with the fuel combustion assembly of the engine by a segment of tubing, thereby ensuring that the conditioned fuel is combusted substantially in a conditioned state and does not have sufficient time to begin to return to a normal unconditioned state. Indeed, a separation of only approximately six inches is preferred.

The fuel conditioning assembly 10 further includes a conditioning assembly. Specifically, the conditioning assembly is disposed within the flow through passage 25 and is structured to at least temporarily chemically condition the fuel flowing through the flow through passage 25. In particular, the conditioning assembly is structured and disposed so as to rearrange the molecular bonds of the fuel with a catalytic effect, and separate the fuel particles into a plurality of subatomic particles. As a result of this conditioning of the fuel, the fuel's density is reduced and the burning efficiency of the fuel is substantially increased. More particularly, as the fuel is treated by the conditioning assembly during its passage through the housing 20 the lesser density, more dispersed fuel is able to more completely burn as a majority of the fuel molecules are subjected to the combustion reaction and can add to the energy provided before being eliminated as exhaust. This reaction has the two-fold effect of increasing the energy that results from the burn, thereby increasing the fuel efficiency, and reducing the harmful particulate that are present in the exhaust emissions, thereby keeping the engine cleaner and in operating condition longer and reducing the environmental pollutants present in the exhaust fumes.

In particular, the conditioning assembly preferably includes a turbulence assembly, which is structured to create a turbulent flow of the fuel within the flow through passage 25. The turbulence assembly is structured to substantially agitate the fuel flowing through the flow through passage 25 and thereby substantially enhance the effects of the conditioning by ensuring that the fuel particulate are substantially dispersed and are fully influenced by the conditioning elements present within the flow through passage 25 and responsible for the conditioning to be achieved. In the preferred embodiment, the turbulence assembly includes a plurality of particulate disposed within the flow through passage 25 and structured to create turbulence in the fuel as it flows therethrough from the inlet end 30 to the outlet end 40 of the housing 20, as best shown in FIG. 2. Moreover, it is preferred that the plurality of particulate include metal shavings 50. Specifically, the entangled, random and dense configuration of an agglomeration of metallic shavings achieves a maximum turbulent effect as the fuel is pushed therethrough and is continuously re routed. In the preferred embodiment, the plurality of metal shavings 50 are formed of stainless steel. Moreover, in the preferred embodiment, the metal shavings 50 are enclosed within mesh 55 or screen, as best shown in FIGS. 2 and 3. Specifically, the mesh 55 is structured in a generally net-like configuration so that it effectively retains the metal shavings 50 therein and provides a substantially large surface area for contacting the fuel. Moreover, the mesh 55 is oriented inside the housing 20 so as to permit the fuel to flow freely therethrough, and through the plurality of metal shavings 50, without allowing any of the metal shavings 50 to exit the housing 20 with the conditioned fuel. In the preferred embodiment, the mesh 55 is formed of Aluminum, although other materials may also be utilized. In the illustrated embodiment, a plurality of wire loops 52 or like fasteners are disposed with the mesh 55, so as to facilitate conditioning and turbulence of the fuel as well as help keep the mesh 55 disposed around the metal shavings 55.

In addition to the turbulence assembly, the conditioning assembly further includes a plurality of metallic elements structured to come into contact with the turbulent flow of fuel through the flow through passage 25 of the housing 20 and cause a catalytic effect in the fuel flow. In particular, the metallic elements of the preferred embodiment which cause the catalytic effect include copper, aluminum and stainless steel, which when all are present and come into contact with a flow of fuel, and preferably a turbulent flow of fuel, initiate the aforementioned chemical conditioning and catalytic reaction that effectuates the conditioning of the fuel. Unlike alternative combinations of elements, these specific preferred elements, present so as to influence the fuel flow, provide significantly enhanced and unexpected results in the extent to which the chemical composition of the fuel is modified and enhanced. Furthermore, although these particular metallic elements could be incorporated into the assembly 10 of the present invention in a variety of manners, such as by providing a plurality of differing metal shavings formed of the various metallic elements or as will be described subsequently with regard to the embodiment of FIG. 4, in the preferred embodiment, the various components of the fuel conditioning assembly 10 are formed such that the necessary combination of metallic elements are disposed to influence the fuel. In particular, in the preferred embodiment, all or part of the housing 20 is formed of copper such that as the fuel flows through the flow through passage 25 it contacts the housing and is influenced by the copper composition thereof. Moreover, the metallic shavings 50, in the preferred embodiment, are stainless steel metal shavings. As a result, as the fuel flows in its turbulent fashion through the metal shavings 50, it comes into contact with the shavings 50 and is influenced by the stainless steel composition thereof. Lastly, in the preferred embodiment, the mesh 55 is formed of aluminum. Accordingly, as the fuel flows through the mesh 55 and into the metal shavings 50, it comes into contact with the aluminum composition of the mesh 55 and is influenced thereby. It is the influence of that combination of elements, in the preferred embodiment, that substantially leads to the enhanced chemical and catalytic reaction which conditions the fuel.

Figure 4:
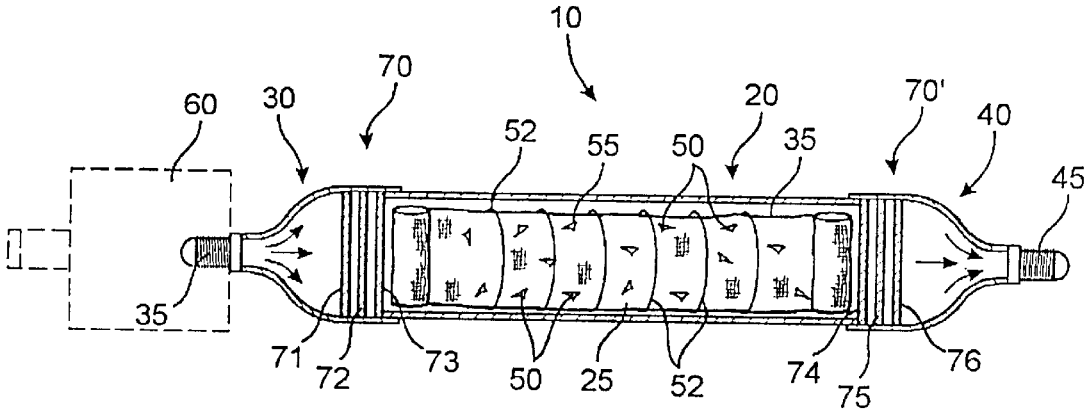
FIG. 4 is a cross-sectional side view of another embodiment of the fuel conditioning assembly.

Turning to FIG. 4, in yet another preferred embodiment at least one, but preferably a plurality of screen elements 70, 70' are provided in operative association with the housing 20. Preferably, the screen elements 70, 70' are disposed at both the inlet end 30 and the outlet end 40 of the housing 20 so as to define inlet screen elements 70 and outlet screen elements 70' and such that fuel flow into and out of the housing 20 must necessarily pass through the screens. While the screens could be formed of another material which does not cause a catalytic effect but merely filters the fuel, in the preferred embodiment, at least one and preferably both the inlet and outlet screen elements 70, 70' at least partially comprise the conditioning assembly. As such at least three screen elements are provided, each of the screen elements 71, 72, 73, 74, 75, 76 which comprise the inlet and/or outlet screen elements being preferably formed of a different one of the metallic elements which cause the catalytic effect, namely copper, aluminum, and stainless steel. For example, it is preferred that three screen elements 71, 72 and 73 comprise the inlet screen elements 70 and be formed of a different material from one another, while three screen elements 74, 75, and 76 formed of different materials from one another define the outlet screen elements 70'. As a result the catalytic effect in the fuel, and therefore the fuel conditioning if not entirely achieved there, can be further enhanced at the inlet end 30 and outlet end 40 of the housing. Of course, as with the other embodiments, the turbulence assembly and other elements within the housing could be formed of other materials metallic or non-metallic, with the copper, aluminum, and stainless steel elements being the primary elements that treat the fuel by causing a catalytic effect. As a result, other treatment elements may be provided for alternative or additional treatment of the fuel in other or increased ways, or other material elements used merely to generate turbulence and define the various components of the housing 20 may be included.

Since many modifications, variations, and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed is:

1. A fuel conditioning assembly comprising:

a housing, said housing including an inlet end, an outlet end, and a flow through passage;

said inlet end being coupled with a fuel supply so as to receive fuel flow therethrough into said flow through passage;

a plurality of metallic elements structured to come into contact with said fuel flow and cause a catalytic effect in said fuel flow so as to at least temporarily condition the fuel and substantially increasing a fuel burn efficiency thereof; and said metallic elements which cause said catalytic effect including substantially only copper, aluminum, and stainless steel and comprising at least three screen elements, each of said screen elements being formed of a different one of said metallic elements which cause said catalytic effect, at least one of said screen elements disposed in covering relation to at least said inlet end of said housing, said screen element being structured to receive said fuel flow therethrough for passage into said flow through passage.

2. A fuel conditioning assembly as recited in claim 1 further comprising at least one screen element disposed in covering relation to at least said outlet end of said housing, said screen element being structured to receive said fuel flow therethrough for passage out of said flow through passage.

3. A fuel conditioning assembly as recited in claim 1 further comprising at least one screen element disposed in line with said fuel flow through said flow through passage of said housing.

4. A fuel conditioning assembly as recited in claim 1 further including a turbulence assembly structured and disposed to create a turbulent flow of the fuel through said flow through passage.

* * * * *